US005216771A

United States Patent [19]

Hoff

[11] Patent Number: 5,216,771

[45] Date of Patent: Jun. 8, 1993

[54] LEG PILLOW

[76] Inventor: Gene A. Hoff, P.O. Box 56455 Deep Run Rd., Martins Ferry, Ohio 43935

[21] Appl. No.: 922,748

[22] Filed: Jul. 31, 1992

[51] Int. Cl.[5] ..... A47C 20/00

[52] U.S. Cl. ..... 5/648; 5/490; 5/652

[58] Field of Search ..... 5/648, 650, 490, 630, 5/636, 652; 602/23, 24

[56] References Cited

U.S. PATENT DOCUMENTS

| | | | |
|---|---|---|---|
| D. 319,751 | 9/1991 | Hoff . | |
| 1,312,886 | 8/1919 | Bawden | 5/636 X |
| 2,056,767 | 10/1936 | Blath . | |
| 2,522,120 | 9/1950 | Kaskey et al. | 5/636 |
| 2,759,200 | 8/1956 | Johnston | 5/490 |
| 3,604,023 | 9/1971 | Lynch | 5/650 |
| 3,795,018 | 3/1974 | Broaded . | |
| 4,007,503 | 2/1977 | Watkin | 5/490 |
| 4,173,048 | 11/1979 | Varaney . | |
| 4,177,806 | 12/1979 | Griffin | 5/650 X |
| 4,480,346 | 11/1984 | Hawkins et al. | 5/490 |
| 4,584,730 | 4/1986 | Rajan . | |
| 4,624,021 | 11/1986 | Hofstetter . | |
| 4,736,477 | 4/1988 | Moore | 5/648 |
| 4,754,510 | 7/1988 | King . | |
| 4,910,818 | 3/1990 | Grabill et al. | 5/648 X |
| 5,117,522 | 6/1992 | Everett | 5/648 |
| 5,125,123 | 6/1992 | Engle | 5/648 |

*Primary Examiner*—Michael F. Trettel
*Attorney, Agent, or Firm*—Richard C. Litman

[57] ABSTRACT

A pillow having an hourglass shape for placing between an individual's legs to provide support when positioned along the upper thighs just above the knees. When the individual is lying on his or her side, the pillow provides for proper alignment of the spine, hips and knees to relieve pain and pressure on muscles, joints and nerves so the body can relax and rest more comfortably. It is beneficial to those who suffer from a variety of back problems, arthritis and sports related injuries as well as those who are convalescent, bedridden or pregnant.

6 Claims, 3 Drawing Sheets

LEG PILLOW

BACKGROUND OF THE INVENTION

1. Field of the Invention

This invention relates to a pillow used for therapeutic purposes and, more particularly, to a pillow which is placed between the legs of an individual to provide support intended to maintain the individual's body in proper alignment.

U.S. Pat. No. 319,751, was issued to this inventor on Sep. 10, 1991, for a design of a pillow to space legs apart and is related to the pillow that is the subject of this invention.

2. Description of the Prior Art

Previous attempts have been made and patented in regard to devices and, in particular, to pillows used to provide support and align various parts of an individual's body. Generally, prior patents disclose pillows which are of such length that they are utilized all along the body of the user, rather than the concept of this invention wherein a body pillow with an hourglass shape is specifically made to fit between the legs of a user. Examples of prior patents include the following.

U.S. Pat. No. 2,056,767 issued on Oct. 15, 1935 to William H. Blath discloses a back pad attachable to the body of a user so that it will be held in position whether the patient is lying in bed or sitting, and which will permit freedom of movement for the spinal column in either position of the wearer.

U.S. Pat. No. 3,795,018 issued on Mar. 5, 1974 to Charley H. Broaded discloses an adjustable bed having a surface with supports of varying heights whereby the head, shoulders and legs are propped. When body members are propped up, the spine of the user is kept in linear alignment.

U.S. Pat. No. 4,173,048 issued on Nov. 6, 1979 to John A. Varaney discloses a pillow configuration having a central head supporting portion forming the top of the pillow and two extension portions positioned substantially perpendicularly to the central portion and extending substantially vertically downwardly therefrom, thus resulting in a pillow construction which provides sleeping comfort for the head and shoulders of the user.

U.S. Pat. No.4,585,730 issued on Apr. 29, 1986 to Eva Rajan discloses a device for stabilizing the pelvis by supporting the lumbar region of an individual. Additional attachments support the individual's hipbones.

U.S. Pat. No. 4,624,021 issued on Nov. 25, 21986 to Jean A. Hofstetter discloses a cushion-like support with a neck extending from the shoulder area to the pelvis to bolster the torso of the user, thereby allowing the pressure points in the lower extremities of the user to be relieved.

U.S. Pat. No. 4,754,510 issued on Jul. 5, 1988 to Harry A. King discloses a body pillow for enhancing sleep or rest which is constructed and arranged to cushion and enfold the entire length of the body while providing a comfortable cushioned separation of the arms and legs of the user.

None of these patents, either taken singly or in combination, disclose the unique construction of the instant invention.

SUMMARY OF THE INVENTION

Accordingly, it is an object, advantage, and feature of the invention to provide a pillow, having an hour glass type construction, which can be used for therapeutic purposes.

It is another object, advantage, and feature of the invention to provide a supporting device which, when positioned from along the upper thighs to just below the knees of a user, supports the body of the user, keeping it in alignment.

It is another object, advantage, and feature of the invention to provide a leg spacing device which provides an even separation of the legs, without readjustment of the device, so that the legs remain stationary in place when an individual turns from said to side.

It is another object, advantage, and feature of the invention to provide a device to relieve pain and pressure on muscles, joints and nerves so that an individual can relax and rest comfortably.

It is another object, advantage, and feature of the invention to provide a leg spacing pillow, which can also be used as a head pillow, an arm pillow, and a shoulder pillow as well as a pillow that can be placed under the legs.

It is still a further object, advantage, and feature of the invention to provide a pillow having a compact construction, yet, having all of the above noted features and being easily transportable for use at remote locations.

It is another object, advantage, and features of the invention to provide a pillow which can provide comfort to those who suffer from disc deterioration, disc herniation, sciatica (pinched nerves), scoliosis (curvature of the spin), pulled muscles, hip and/or knee replacements or surgery, arthritis, post-surgery convalescence, sports related injuries, being bedridden, being pregnant, and insomnia as well as anyone interested in maintaining good health.

These, and other objects, advantages, and features of the invention will become apparent from the following description, drawings and claims.

BRIEF DESCRIPTION OF THE DRAWINGS

Like numerals refer to like components throughout the following description.

DETAILED DESCRIPTION OF THE PREFERRED EMBODIMENT

Figure 1:
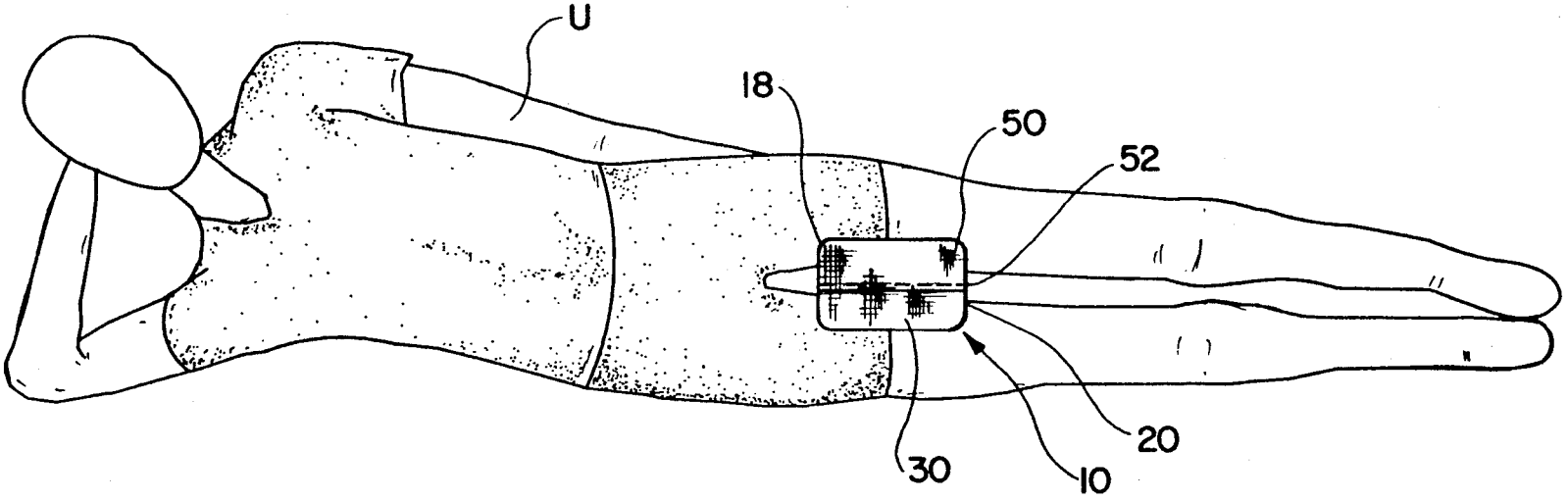
FIG. 1 is an environmental elevational view of the invention.
Figure 4:
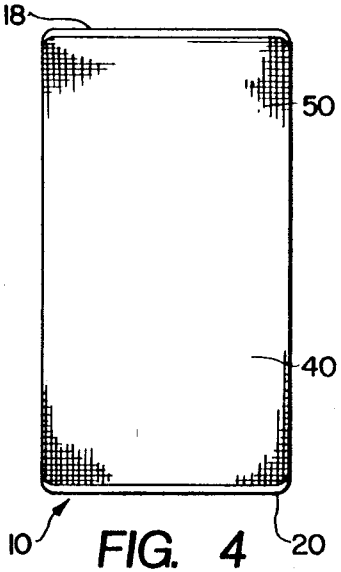
FIG. 4 is a rear elevation view thereof.
Figure 2:
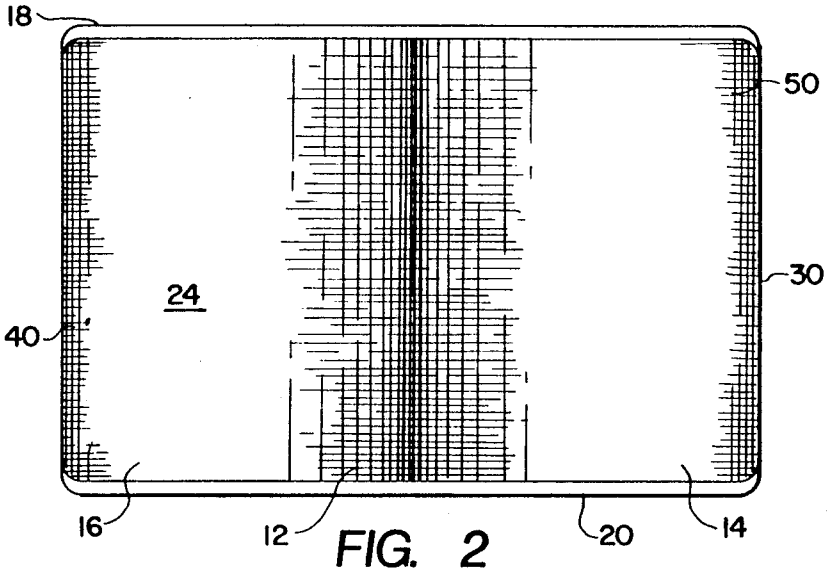
FIG. 2 is a top plan view thereof.
Figure 3:
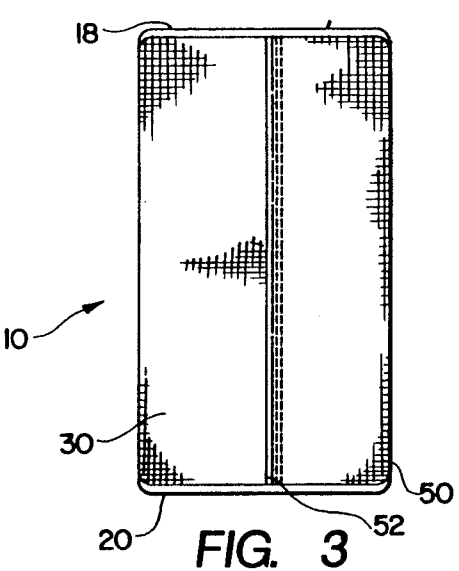
FIG. 3 is a front elevation view thereof.
Figure 5:
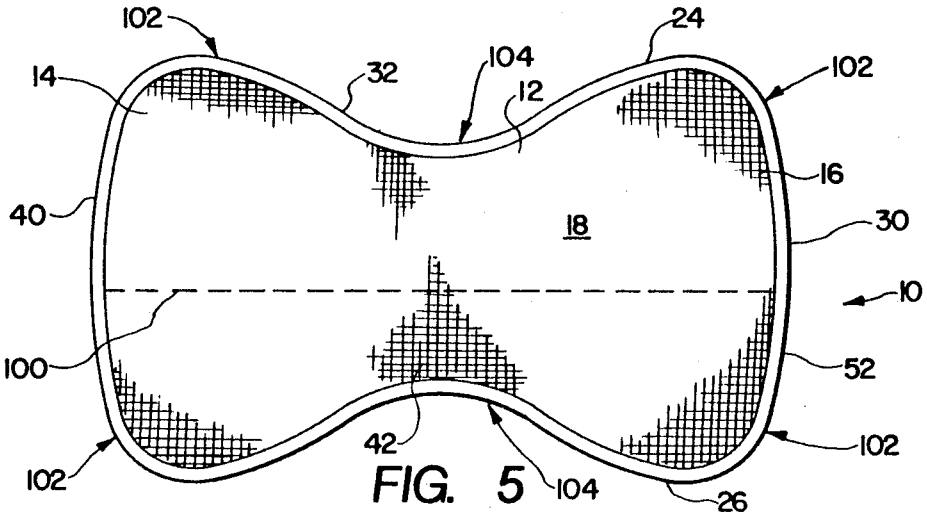
FIG. 5 is a side elevation view thereof.
Figure 6:
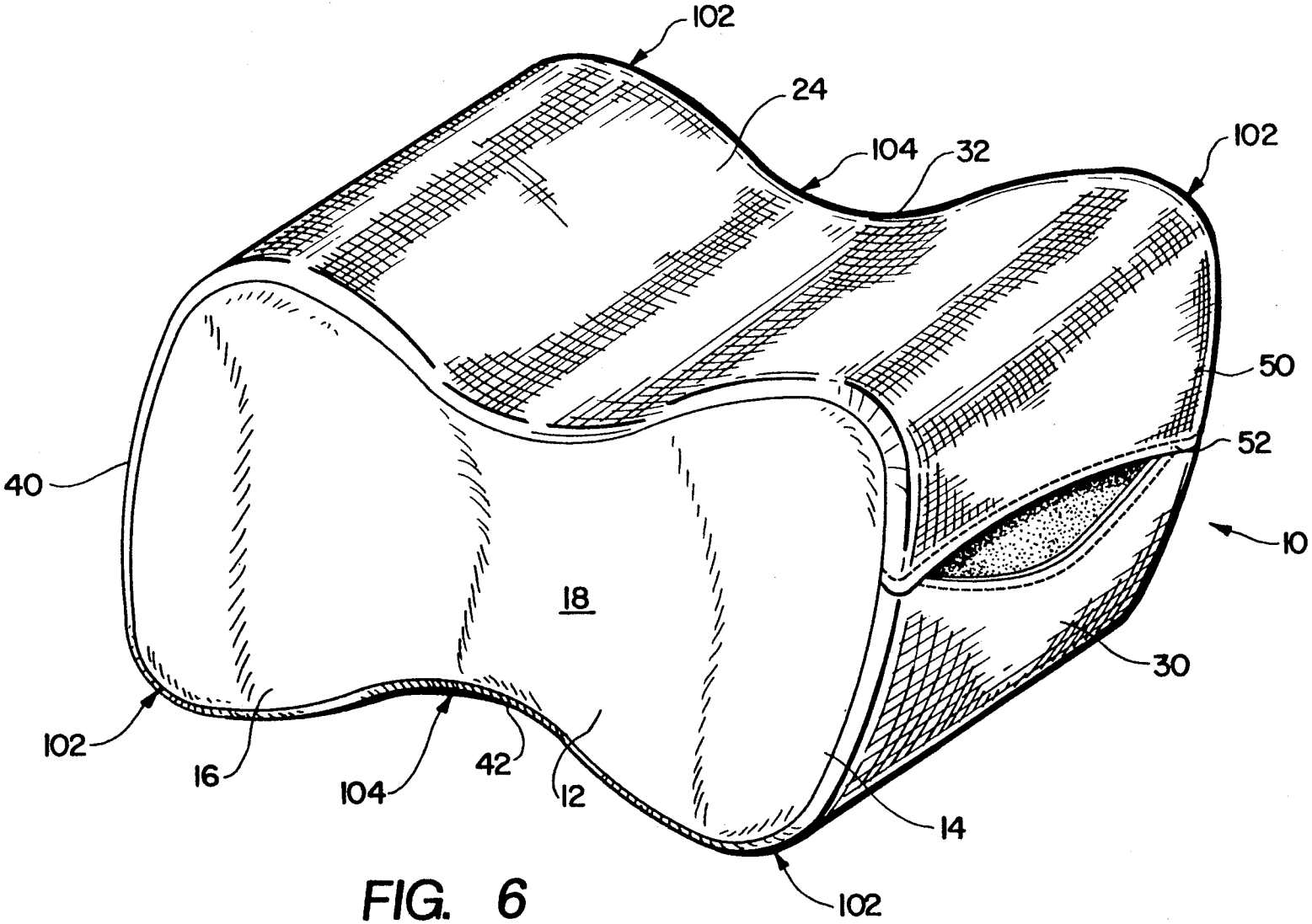
FIG. 6 is a perspective view thereof showing of the cover being partially removed therefrom.

Referring now to the drawing, pillow or cushion device 10 having an hourglass (dog bone or dumbbell) shape is shown. The pillow 10, having a one piece construction, includes a medial section 12, a first end section 14, a second end section 16, side wall 18, opposing sidewall 20, first outer face 24, second outer face 26, front wall 30, rear wall 40, and intermediate leg engaging areas 32 and 42. The pillow 10 a major longitudinal axis 100, as shown in FIG. 5. This aids in defining the contour design of the pillow 10 as described hereinafter. The first and second outer faces 24, 26 include, proximate to each of the end sections 14, 16, two smooth convex bulges 102 that extend completely from side wall 18 to opposing side wall 20. These bulges 102 are convex in relation to and along the longitudinal axis 100, as can be clearly seen in FIG. 5, and two of them extend from the front wall 30 to the medial section 12, while the other two extend from the rear wall 40 to the medial section 12. The medial section 12 includes a pair of concave depressions 104 that also extend completely from the side wall 18 to the opposing side wall 20 and are concave in relation to and along the longitudinal axis 100. Both the convex bulges 102 and the concave depressions 104 define the leg engaging ares 32 and 42. Further, pillow 10 has a cover 50, having a self closing open seam 52 therein.

Pillow 10 is placed between the legs of a user while the individual is lying down or sleeping on one side, and is designed to relieve pressure from back and hip muscles. Pillow 10 fits comfortably between the legs of the user U, keeping the legs in line with the spine, thus reducing pressure on the spine and the nerves as the muscles relax. Pillow 10 is preferably made of 100% polyurethane and is light weight and easy to adjust for comfort with a minimum of movement. With the contour design, pillow 10 will usually move with the user U when the user U turns over, allowing for uninterrupted sleep. The smooth convex bulges 102 are configured so as to not catch on the mattress or become entangled in bedclothes, sheets, or the like of the user turns over during sleep. Cover 50 is preferably made of preshrunk cotton fabric and is removable for machine washing and will not shrink when dried properly. Also, the cover 50 can be made of an antibacterial (staph check) material or waterproof or water resistant material.

Pillow 10 can be manufactured in various sizes. For proper fit for most individuals, a six inch by eight inch by ten inch size would be desired. For smaller individuals and children, a five and one half inch by six and one half inch by nine inch size would be desired. Special sizes can be manufactured for individuals who have undergone hip surgery or hip replacements.

By providing proper separation of the legs, pillow 10 functions as a cushion device having therapeutic use. It is an elongated resilient member having opposite and sections 14 and 16 joined at medial section 12. Fabric cover 50 enshrouds and tightly conforms to the configuration of the resilient pillow 10. Pillow 10 includes the substantially planar opposing side walls 18 and 20 spanned by front wall 30, rear wall 40, first outer face 24 and second outer face 26. First outer face 24 and second outer face 26 each have intermediate leg engaging areas 32 and 42, respectively, whereby medial section 12 defines a neck down configuration with first outer face 24 and second outer face 26 curved from end sections 14 and 16 to define the concave depressions 104 in medial section 12. Pillow 10 has a major longitudinal axis 100 extending through the medial section 12 and the end sections 14, 16 that defines a length no less than a typical human thigh in the preferred embodiment. Pillow 10 is sandwiched between the legs of a person in a supine position so that pillow 10 remains between the legs as the person turns form side to side. Opposed portions of the user Us legs engage pillow 190 and are maintained evenly spaced apart. Proper ventilation between the legs, as well as proper support and alignment of the sine, hips and knees are obtained so as to relieve pain and pressure on muscles, joints and nerves enabling the body to relax and rest comfortably.

The description herein is an example of the invention and is by no means to be considered limiting on the scope of the claims appended hereto. Any variations of the preferred embodiment are considered within the scope of the invention.

What is claimed is:

1. A cushion device for therapeutic use by humans, said cushion device comprising:

an elongated resilient member having opposite end sections joined to a medial section and having a major longitudinal axis extending through said end sections and said medial section;

said resilient member including substantially planar opposite side walls respectively spanned by a front wall, a rear wall, a first outer face, and a second outer face;

said first and second outer face each having an intermediate leg engaging area proximate said medial section, each of said leg engaging areas being smoothly concave in relationship to and along said major longitudinal axis and symmetrical thereto;

said first and second outer face each further including a pair of smooth bulges, each of said bulges proximate one of said end sections, said bulges being convex in relation to and along said longitudinal axis, said bulges being symmetrical to one another, where one of said bulges extends from said front wall to said medial section and the other said bulge extends from said rear wall to said medial section; and wherein said longitudinal axis defines a length of no less than that of a human thigh; whereby said cushion device, when sandwiched between the legs of a person in the supine position and upon one side, maintains this location between the legs as the person turns form side to side due to the legs of the person being engaged by said concave leg engaging areas while said smooth convex bulges proximate said end sections further assist in maintaining the device in plate and also aid in preventing said cushion from being inadvertently dislodged if the user turns from side to side during sleep.

2. A cushion device as defined in claim 1, comprising a cover enshrouding and tightly conforming to the configuration of said resilient member.

3. A cushion device as defined in claim 2, wherein said cover is a fabric.

4. A cushion device as defined in claim 2, wherein said cover is removable.

5. A cushion device as defined in claim 4, wherein said removable cover has a self-closing seam.

6. A cushion device a defined in claim 7, wherein the size of said device varies depending upon the thickness of the thigh of the user.

* * * * *

UNITED STATES PATENT AND TRADEMARK OFFICE

CERTIFICATE OF CORRECTION

PATENT NO. : 5,216,771
DATED : June 8, 1993
INVENTOR(S) : Gene A. Hoff

It is certified that error appears in the above-identified patent and that said Letters Patent is hereby corrected as shown below:

Column 4,
Line 57, after "claim" cancel "7" and insert -- 1 --.

Signed and Sealed this

Twenty-fourth Day of September, 2002

*Attest:*

*Attesting Officer*

JAMES E. ROGAN
*Director of the United States Patent and Trademark Office*